US005335815A

United States Patent [19]

Josselyn

[11] Patent Number: 5,335,815

[45] Date of Patent: Aug. 9, 1994

[54] STORAGE TANK IN A PRECAST, PROTECTIVE SHELL

[75] Inventor: Allan H. Josselyn, Arlington, Va.

[73] Assignee: The Reinforced Earth Company, Vienna, Va.

[21] Appl. No.: 45,378

[22] Filed: Apr. 9, 1993

[51] Int. Cl.[5] ..... B65D 90/12

[52] U.S. Cl. ..... 220/445; 220/437; 220/466; 220/565; 220/571

[58] Field of Search ..... 220/565, 445, 469, 4.24, 220/4.21, 400, 435, 437, 439, 466, 23.83, 23.86, 672, 669, 571; 206/586, 592; 52/404, 406, 126.1, 126.5

[56] References Cited

U.S. PATENT DOCUMENTS

| | | | |
|---|---|---|---|
| 2,560,249 | 7/1951 | Risch | 206/586 |
| 3,129,868 | 4/1964 | Jenk | 206/586 |
| 3,669,299 | 6/1972 | Jones et al. | 220/445 |
| 4,960,222 | 10/1990 | Fields, III | 220/445 |
| 5,033,638 | 7/1991 | Cruver et al. | 220/571 |
| 5,114,046 | 5/1992 | Bryant | 220/571 |
| 5,199,484 | 4/1993 | Schatz | 220/445 |
| 5,249,698 | 10/1993 | Cruver et al. | 220/571 |

FOREIGN PATENT DOCUMENTS

| | | | |
|---|---|---|---|
| 2214383 | 10/1973 | Fed. Rep. of Germany | 52/126.5 |

*Primary Examiner*—Allan N. Shoap
*Assistant Examiner*—S. Castellano

[57] ABSTRACT

A method for mounting a tank in a compatible precast concrete half shell wherein the tank is supported on ribs at a spaced distance from the inner wall of the half shell includes positioning of the half shell by means of at least partially filled, flexible containers of coagulate material which are wedged between the container and the inner wall of the half shell.

6 Claims, 2 Drawing Sheets

STORAGE TANK IN A PRECAST, PROTECTIVE SHELL

BACKGROUND OF THE INVENTION

This invention relates to an improved method for mounting a generally cylindrical tank in a precast or preformed, generally congruent shaped half shell.

In U.S. Pat. No. 5,033,638 entitled "Above Ground Hazardous Liquid Storage Apparatus," there is disclosed a liquid storage tank construction comprised of a supportive, precast, outer lower half shell which receives and retains a separate internal cylindrical steel tank for storing liquids. The precast, outer half shell is combined with a generally mirror image, upper half shell that covers the tank. The half shells both include internal ribs which support and locate the cylindrical tank and maintain it in a generally fixed position spaced from the interior walls of the half shells.

The half shells are typically constructed from a reinforced concrete material. The lower half shell in combination with the upper half shell thus defines a vault for a tank. The vault retains fluid which might be leaking from the tank. In this manner, leakage from the tank into the environment is precluded. Consequently, the tank, which may contain hazardous materials, can be easily stored above ground where it is protected by the concrete shell from environmental hazard and other hazards which might impact on the tank, but where it is easily inspected and accessible for replacement or repair.

During the fabrication of such apparatus, it is necessary to appropriately align the tank on the support ribs within the lower half shell. Because the tolerances associated with the materials comprising the half shells are quite different from those associated with the storage tank, there may be a significant dimensional difference between the support ribs of the lower half shell and the tank. Thus, merely lowering the steel tank onto the ribs within the lower half shell may not satisfactorily position the tank within that half shell. Consequently, there has developed a need for a device and a process by which the cylindrical tank may be appropriately and properly positioned within the lower half shell so that the upper half shell may be properly placed over and mated with the lower half shell to effectively and efficiently protect the internal steel tank.

SUMMARY OF THE INVENTION

Briefly, the present invention comprises a device as well as a process for precisely positioning and mounting a cylindrical tank in a compatible precast, concrete half shell. Specifically, a flexible container or sock is filled with a hardenable coagulate material, and the material is sealed within the container or sock. The tank is then lowered into the half shell and the sock is positioned at the corners or other strategic support positions of the cylindrical tank. The sock is thus positioned intermediate the tank and the half shell inner wall and/or ribs. Because the flexible containers or socks are flexible and are filled with flowable, coagulate material, the material may form against the tank and fill any voids between the tank and the half shell. By adjusting and manipulating the tank against the socks or flexible containers, the tank is appropriately positioned and maintained in position. The coagulate material then hardens to rigidly support and fix the tank within the half shell. The top half shell may then be positioned over the tank to form an enclosure about the cylindrical tank.

Thus, it is an object of the invention to provide an improved method for positioning a cylindrical steel tank within a precast concrete half shell.

It is a further object of the invention to provide a simple yet flexible device which is useful for positioning a tank within a half shell and which can be safely used with a minimum of risk in the process of using the device.

Yet another object of the invention is to provide a container with a coagulate material that is hardenable for use as a support of a tank in a half shell.

Yet a further object of the invention is to provide a flexible container partially or fully filled with a coagulate material and configured so as to be easily, effectively and safely used in assisting the positioning and maintenance of position of a tank within a half shell.

These and other objects, advantages, and features of the invention will be set forth in the detailed description which follows.

BRIEF DESCRIPTION OF THE DRAWING

In the detailed description which follows reference will be made to the drawing comprised of the following figures:

FIG. 3 is cross sectional view of the improved construction of the invention taken it along the line 3—3 in FIG. 1 illustrating a variety of embodiments of the invention;

FIG. 3A is an enlarged plan view of the device depicted in FIG. 3;

FIG. 3B is an enlarged plan view of another embodiment or use of the device depicted in FIG. 3;

DESCRIPTION OF THE PREFERRED EMBODIMENTS

Figure 1:
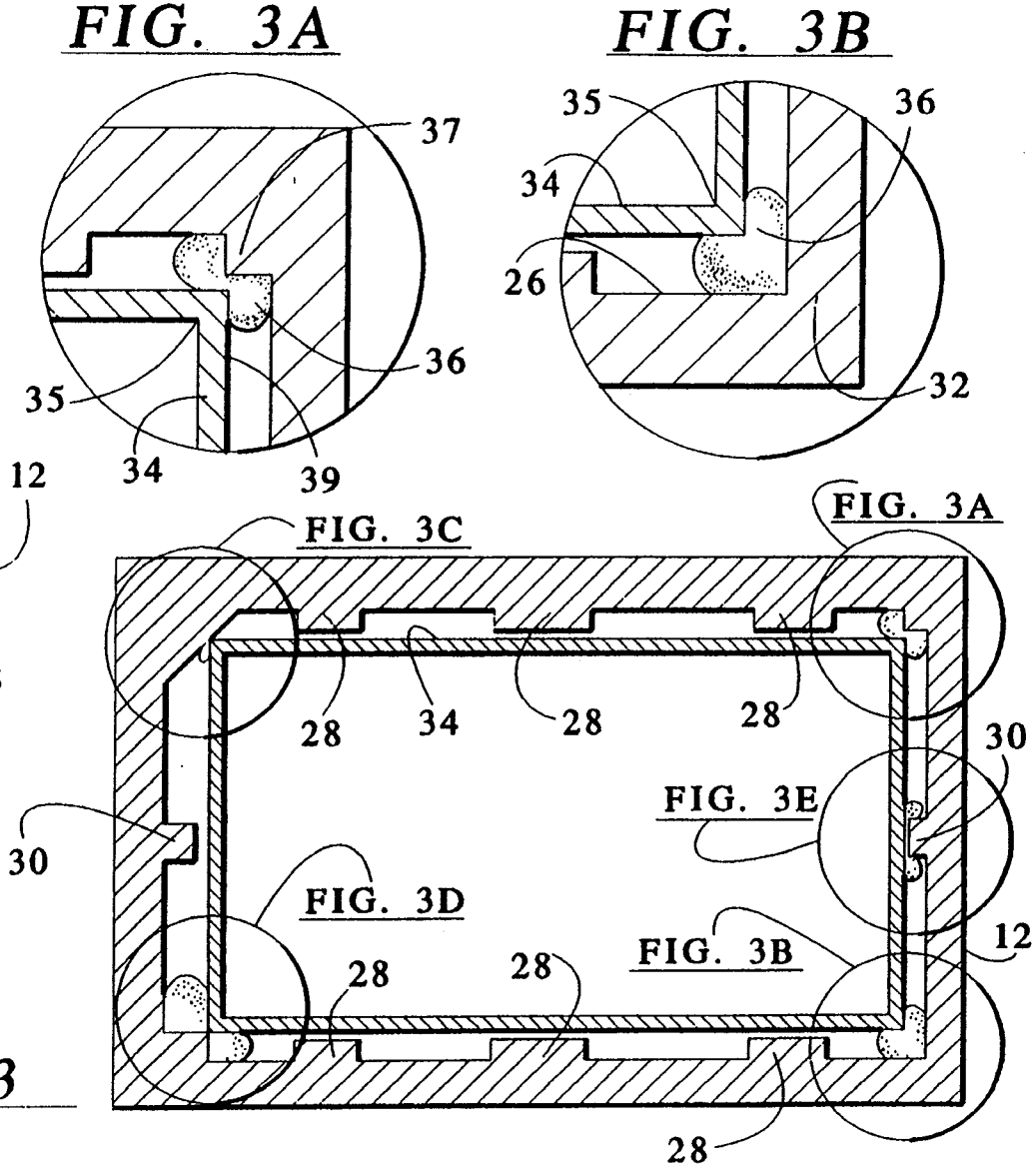
FIG. 1 is an isometric view of a precast tank assembly comprised of an upper half shell and a lower half shell mounted on supports with an interior cylindrical steel tank supported therein.
Figure 1:
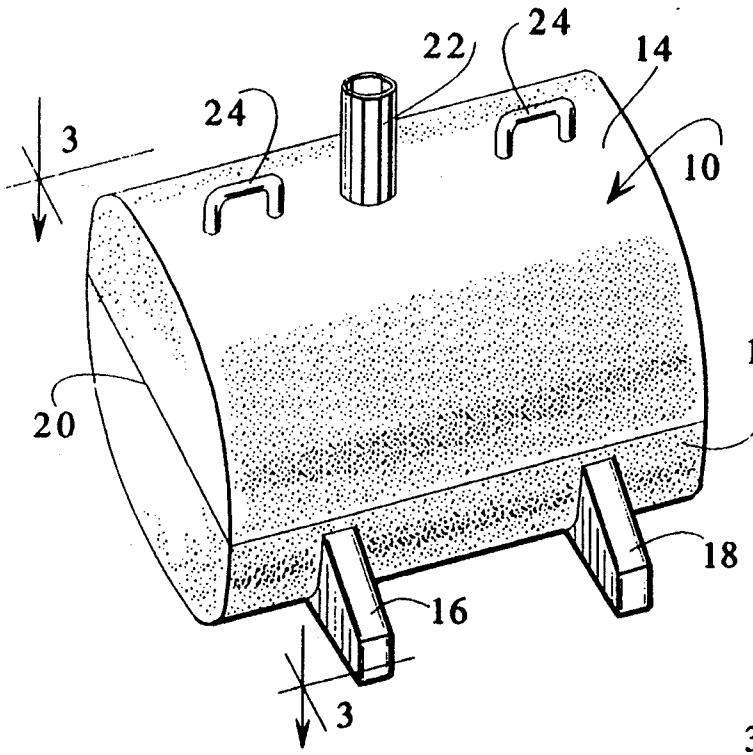

Referring first to FIG. 1, there is illustrated an isometric view of the vault construction incorporating the invention. Specifically, the vault construction 10 is comprised of a lower, precast half shell 12 and an upper, precast half shell 14. The lower half shell 12, which is semi-cylindrical in shape, is supported on spaced support legs 16 and 18 which receive or cradle the lower half shell 12. The upper half shell 14 is substantially a mirror image of the lower half shell 12. Each of the shells 12 and 14 have a generally hollow interior. They are joined together along a seam 20 which is preferably sealed.

The upper half shell 14 includes vent and access pipes 22, for example, and other optional inlet and outlet pipes (not shown). Lift brackets 24 cast into the upper half shell 14 permit support, lift or elevation of the half shell 14, for example, during positioning thereof on the lower half shell 12. The shells 12, 14 are fastened together to provide a generally fluid tight chamber.

Figures 2, 3C, 3D, 3E, 4, 5:
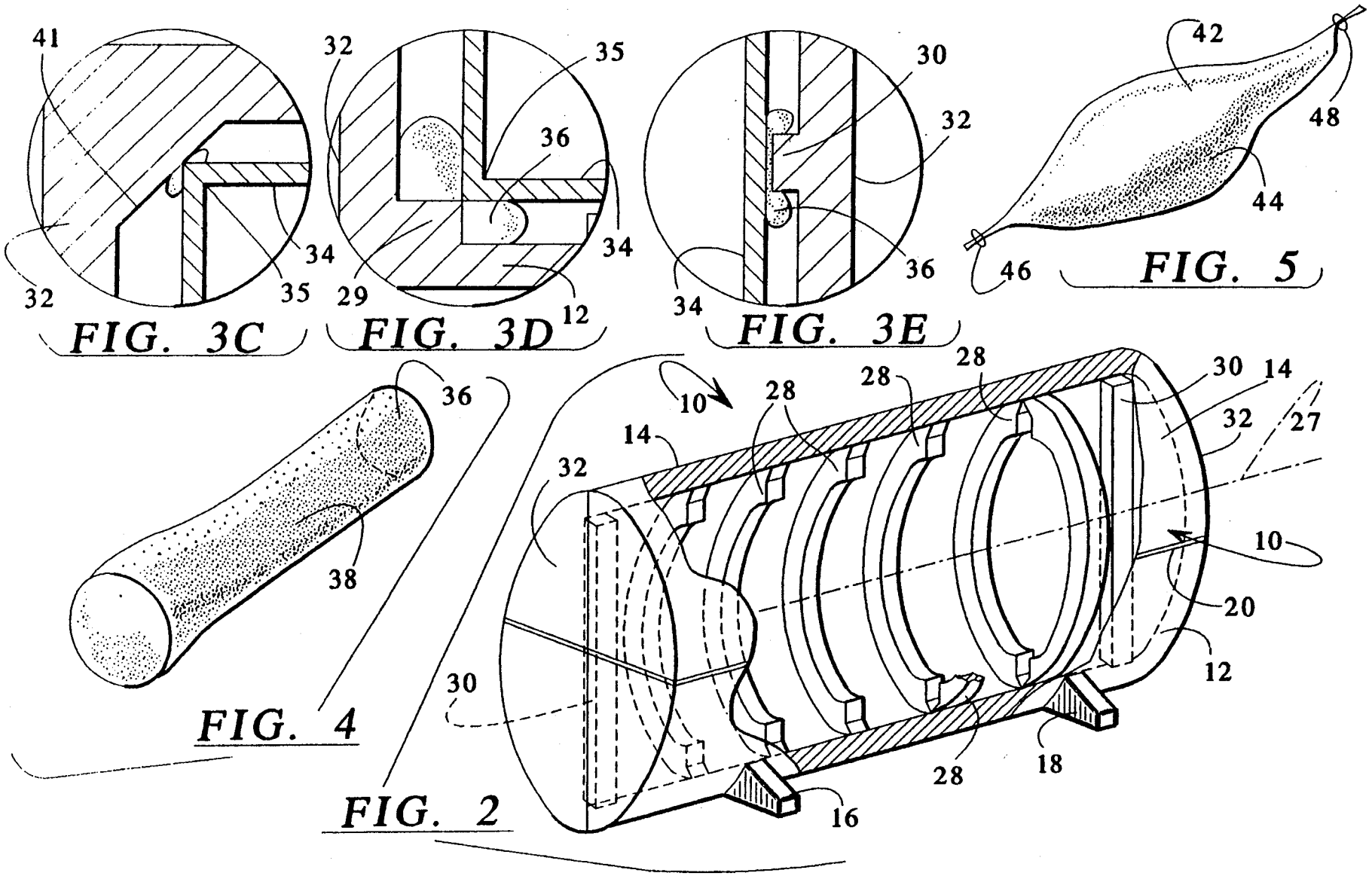
FIG. 2 is an isometric view of the tank of FIG. 1 partially sectioned to show the construction of the interior of the support ribs for the tank.
FIG. 3C is yet another enlarged plan view of a device depicted in FIG. 3.
FIG. 3D is yet another enlarged plan view of a device depicted in FIG. 3.
FIG. 3E is a further enlarged plan view of a device depicted in FIG. 3.
FIG. 4 is an enlarged isometric view of a container or sock which retains a hardenable coagulate.
FIG. 5 is an enlarged isometric view of an alternate construction of a container or sock which retains a hardenable coagulate.

FIG. 2 illustrates the internal construction of the half shells 12 and 14. As previously stated, the half shells 12 and 14 are generally mirror images of one another and separate along a seam or juncture 20. Thus, the lower half shell 12 comprises a cylindrical panel 25 which includes an inner wall 26 with spaced diametrical ribs 28 extending from the inner wall 26 toward the center axis 27 of the cylinder defined by the vault 10. Transverse end walls 32 enclose the opposite ends of the panel. Vertical end ribs 30 may be provided in each transverse end wall 32 on the inside of each half shell 12 and 14. Ribs 28 and 30 serve to support and/or space a steel tank 34 depicted in cross-section in FIG. 3. The tank 34 is thus spaced from the inner wall 26 supported on ribs 28, and spaced from end walls 32. The construction so far described is like that depicted in U.S. Pat. No. 5,033,638. The construction of the ribs 28 may be like that depicted in U.S. Pat. No. 5,033,638, or any other rib construction which provides for support of tank 34 spaced from inner wall 26. Tank 34 is thus enclosed within the vault 10 and spaced from the inner wall 26 thereof defined by the lower half shell 12 and the upper half shell 14.

As can be appreciated, the assembly process of the vault 10 comprises positioning the lower half shell 12 on the legs 16 and 18 and stabilizing this construction. The legs 16 and 18 as well as lower half shell 12 are typically a reinforced concrete construction for which the manufacturing tolerances are difficult to maintain to a high degree. A cylindrical steel tank 34 is then positioned on the ribs 28 intermediate the ribs 30 of the lower half shell 12. The upper half shell 14 is then lowered onto the lower half shell 12 for support at the seam 20. Sealing material may be inserted at the seam 20 to seal the seam 20 between the upper half shell 14 and lower half shell 12 to provide a fluid tight construction.

During the assembly of the half shells 12 and 14 and tank 34, positioning of the tank 34 properly within the half shells 12, 14 requires that the tank 34 be appropriately and properly aligned. This is necessary so that the tank 34 will not be out of alignment with the ribs 28 of upper half shell 14 when the upper half shell 14 is positioned over the lower half shell 12. This alignment process is generally an important part of the construction process. Heretofore, this alignment process was somewhat difficult. With the present invention proper alignment of the tank 34 upon the ribs 28 and intermediate end ribs 30 is enhanced and made much easier.

Specifically referring to FIGS. 4 and 5, a container 36, 42 which is made from a flexible, air pervious material, for example, fabric container 36, is filled (partially or fully) with a hardenable coagulate material 38, 44. The coagulate material 38, 44 may be a mortar for example. Most typically, the container 36 comprises a fabric sock or some other flexible material which will retain the coagulate material 38, will let air and moisture escape through the material 38, but which will retain the coagulate material 38. In FIG. 4, the container 36 is generally cylindrical with the opposite ends of the cylindrical container 36 being closed by transverse end sections 40. FIG. 5 illustrates an alternative. In FIG. 5, a container 42 is comprised of a flexible material which contains a coagulate 44. The container 42 is sealed or tightly constricted at one end by a metal clip 46, for example. The coagulate material 44 is then placed within the container 42 and the opposite end sealed with a second metal clip or fastener 48. The amount of coagulate material 38 or 44 within the respective containers 36 and 42 is typically more than one-half ( e.g. three-fourths) of the capacity of the container 36 or 42. In this manner, the container can be manipulated or formed in a variety of shapes for the purpose to be described below.

Reference is now made to FIGS. 3 and 3A through 3E. There is illustrated the various uses of coagulate filled containers 36, 42 of the type shown in FIGS. 4 and 5. Briefly, those containers 36, 42 are inserted intermediate the inner wall 26 and the tank 34. Because the containers 36 or 42 are flexible or elastic and partially or fully filled with a hardenable coagulate material, they may be shaped or adjusted to wedge or retain the tank 34 in a desired and appropriate orientation within the lower half shell 12. FIG. 3A depicts how such a container 36 may be wedged or positioned at a corner of tank 34. Thus, corner 35 of tank 34 is juxtaposed opposite an internal circumferential rib 37 along an end panel 39 of the tank 34. A container 36 which is partially filled with hardenable coagulate material may be wedged between the tank 34 and the rib 37 as well as the inner wall 26.

Similarly, referring to FIG. 3B a filled container 36 may be wedged at a corner 35 of tank 34 between the tank 34 and inner wall 26. FIG. 3C illustrates yet a further positioning of a container 36 between an angled rib 41 and a corner 35 of tank 34. FIG. 3D illustrates yet another arrangement of this type wherein a container 36 is positioned between tank 34 and a fully sized rib 29 on inside of the end 32 of the lower half shell 12. FIG. 3E discloses and depicts how such a container 36 can be positioned between a rib 20 and the tank 34. The positioning of the container 36 between the tank 34 and the ribs 28 is also possible.

In any event, upon lowering of the tank 34 into a lower half shell 12, containers 36, 42 of hardenable material 38 or 44 are positioned strategically between the tank 34 and the inside of the lower half shell 12. In this manner, the tank 34 is appropriately oriented so that the upper half shell 14 may be safely lowered to form the closed vault 10. The hardenable material within the containers, such as container 36, will then harden to preclude any shifting in position of the tank 34. Because the container 36 is elastic, there is enough flexibility and movement permitted by appropriate adjustment of the container 36 so that it serves as an appropriate wedge between the tank 34 and the lower half shell 12.

It is, of course, possible to practice variants of the invention and still be within the scope and meaning of the claims appended hereto. For example, the construction of containers and the contents thereof may be varied widely. The construction of the ribs 28 and the shape of the ribs, the lower half shell 12, and the tank 34 may all be varied. The invention and the method thereof are therefore limited only by the following claims and their equivalents.

What is claimed is:

1. In combination, a cylindrical tank with a cylindrical side wall and closed ends serving as a fluid vessel;

a cylindrical lower half shell with an inside wall on an outer portion of the shell, tank supports integrated with the half shell and defining an inner portion of the shell, and the tank support project from the inside wall, said half shell tank supports compatible with the cylindrical tank and supportive of the tank in the lower half shell spaced from the inside wall of the outer portion of the half shell, the inside wall retains leakage from the tank within the lower half shell, said lower half shell defining spaced corners at the tank ends; and partially filled, pervious, closed ended, flexible containers being filled with hardenable coagulate material, said flexible containers positioned at said corners intermediate the lower half shell and the cylindrical tank to thereby position and locate the tank within the half shell in a desired orientation, said flexible containers being pervious to air and moisture, but not previous to the coagulate material, said coagulate material in the flexible containers capable of forming a rigid tank support of hard material surrounded by the flexible container when the hardenable coagulate material hardens to thereby retain the cylindrical tank in said orientation in the lower half shell.

2. The combination of claim 1 wherein each of the flexible containers is less than filled with the coagulate material which hardens to rigidly hold the tank in the half shell.

3. The combination of claim 1 wherein the flexible containers are about three-fourths filled.

4. The combination of claim 1 wherein the flexible containers are elongated generally cylindrical elastic tubes closed at each end and partially filled with the hardenable coagulate material.

5. The combination of claim 1 wherein the flexible containers are positioned at least at one corner.

6. The combination of claim 1 wherein the flexible containers are positioned at each corner.

* * * * *